US011738940B1

(12) United States Patent
McLaughlin et al.

(10) Patent No.: US 11,738,940 B1
(45) Date of Patent: Aug. 29, 2023

(54) SIDE-TO-SIDE FLIP ROOF FOR WASTE CONTAINERS

(71) Applicant: MCLAUGHLIN WASTE EQUIPMENT INC., Lockeford, CA (US)

(72) Inventors: Danny M. McLaughlin, Galt, CA (US); Lanny R. Williams, Stockton, CA (US)

(73) Assignee: MCLAUGHLIN WASTE EQUIPMENT INC., Lockeford, CA (US)

( * ) Notice: Subject to any disclaimer, the term of this patent is extended or adjusted under 35 U.S.C. 154(b) by 0 days.

(21) Appl. No.: 17/804,985

(22) Filed: Jun. 1, 2022

Related U.S. Application Data

(60) Provisional application No. 63/216,887, filed on Jun. 30, 2021.

(51) Int. Cl.
*B65D 43/20* (2006.01)
*B65F 1/14* (2006.01)
*B65F 1/16* (2006.01)

(52) U.S. Cl.
CPC ..... *B65F 1/1421* (2013.01); *B65F 1/16* (2013.01)

(58) Field of Classification Search
CPC ..... B65F 1/1421; B65F 1/16
See application file for complete search history.

(56) References Cited

U.S. PATENT DOCUMENTS 2,338,477 A * 1/1944 Wolters ..... A47B 63/00 312/319.2
3,961,723 A * 6/1976 Eckel ..... B65D 43/14 220/812
4,653,662 A * 3/1987 Wise ..... B65F 1/16 220/345.5
4,821,902 A * 4/1989 May ..... B65F 1/16 220/812
4,934,562 A * 6/1990 Early ..... B65D 90/008 220/812
5,011,168 A 4/1991 Deamicis
6,364,154 B2 4/2002 Kruzick
(Continued)

FOREIGN PATENT DOCUMENTS

CA 2709598 1/2012
FR 3070640 3/2019

OTHER PUBLICATIONS

Wastequip, "Roll-Off Container Covers", Roll-Off Container Cover Brochure WQP102-042018, www.wastequip.com, pp. 1-4, Apr. 2018.

*Primary Examiner* — Amy J. Sterling
(74) *Attorney, Agent, or Firm* — O'Banion & Ritchey LLP; John P. O'Banion

(57) ABSTRACT

A side-to-side flip roof has the ability to be manually opened from both sides of a waste container by use of a manually operated handle. A carriage, carrier assembly, and pivot system allows for filling of the container from either side. This product has a plastic full-length roof to resist water ingress to meet legal storm water preparedness requirements. It holds up under extremely rigorous usage. For weight restriction reasons, plastic sheeting appears the best material to use for this roof. The roof mechanism allows a single person to open the roof with height of the box up to 8', or more. This flip roof is additionally lockable.

12 Claims, 13 Drawing Sheets

(56) References Cited

U.S. PATENT DOCUMENTS

| | | | | |
|---|---|---|---|---|
| 6,394,496 | B1 * | 5/2002 | Piona | B65D 88/126 280/830 |
| 6,732,883 | B2 * | 5/2004 | Petzitillo, Jr. | B65D 88/126 220/826 |
| 9,434,539 | B2 * | 9/2016 | Boesch | B65D 90/58 |
| 10,272,814 | B2 | 4/2019 | Haag | |
| 10,752,437 | B2 * | 8/2020 | Kemp | B65D 88/126 |
| 2002/0017529 | A1 * | 2/2002 | Kruzick | B65F 1/1615 220/908 |
| 2020/0262646 | A1 * | 8/2020 | Boesch | B65D 90/582 |

* cited by examiner

SIDE-TO-SIDE FLIP ROOF FOR WASTE CONTAINERS

CROSS-REFERENCE TO RELATED APPLICATIONS

This application claims priority to, and the benefit of, U.S. provisional patent application Ser. No. 63/216,887 filed on Jun. 30, 2021, incorporated herein by reference in its entirety.

STATEMENT REGARDING FEDERALLY SPONSORED RESEARCH OR DEVELOPMENT

Not Applicable

NOTICE OF MATERIAL SUBJECT TO COPYRIGHT PROTECTION

A portion of the material in this patent document may be subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND

1. Technical Field

The technology of this disclosure pertains generally to waste transport and more particularly to covered waste transport manually accessible to two sides.

2. Background Discussion

Waste containers must typically be covered to prevent littering their contents while being transported. However, such covered containers typically allow loading of the container only from one side or the other. In many situations, to achieve waste loading, such covered containers must be physically rotated end-to-end to allow the loading of an otherwise misoriented container.

Even worse are waste containers that do not have attached lids. Such containers are prone to transport littering, and must otherwise be covered by a separate lid or roof structure, or covered with a tarp of some sort. While such containers do not require reorientation, they do require the additional step of covering the waste to prevent transport road litter, and the storage of the container covering when it is not in use.

Littering generated from the transportation of waste containers is a legal requirement in many states, thereby making it mandatory that waste containers be covered.

Additionally, waste containers may become contaminated by rain water, frequently turning the waste into a sodden mess. For this reason, traditional tarps are of little use, as they must be further supported to shed rain, otherwise pooling and eventual water leakage into the waste likely ensues.

BRIEF SUMMARY

A side-to-side flip roof is described here. The flip roof is accessible from either side of a waste container, and is easily manually manipulated between open and closed from either side of the waste container.

A side-to-side mechanism is used to provide most of the translation of the flip roof roughly parallel to the top of the waste container through a primary translational motion. After the limit of the primary translational motion is reached, the mechanism continues translation in the same direction with a secondary translational motion. This secondary translational motion allows for a translation of the pivot of the flip roof to extend beyond the extent of the waste container, and thereby permits the flip roof to be readily flipped to a substantially vertical position, thereby opening the waste container for usage.

The side-to-side mechanism is mounted to both sides of the waste container, typically by welding or other suitable mechanical fastening.

After waste container usage, the flip roof is again manually flipped into a horizontal position, and rolled to a covered position with the side-to-side mechanism. In the covered position, the waste container is substantially water tight, resisting water ingress and thereby preventing water contamination of the waste container contents.

Further aspects of the technology described herein will be brought out in the following portions of the specification, wherein the detailed description is for the purpose of fully disclosing preferred embodiments of the technology without placing limitations thereon.

BRIEF DESCRIPTION OF THE SEVERAL VIEWS OF THE DRAWINGS

The technology described herein will be more fully understood by reference to the following drawings which are for illustrative purposes only:

FIG. 1D, wherein the roof has been rolled open and flipped substantially vertically using a manual handle.

DETAILED DESCRIPTION

Figure 1A:
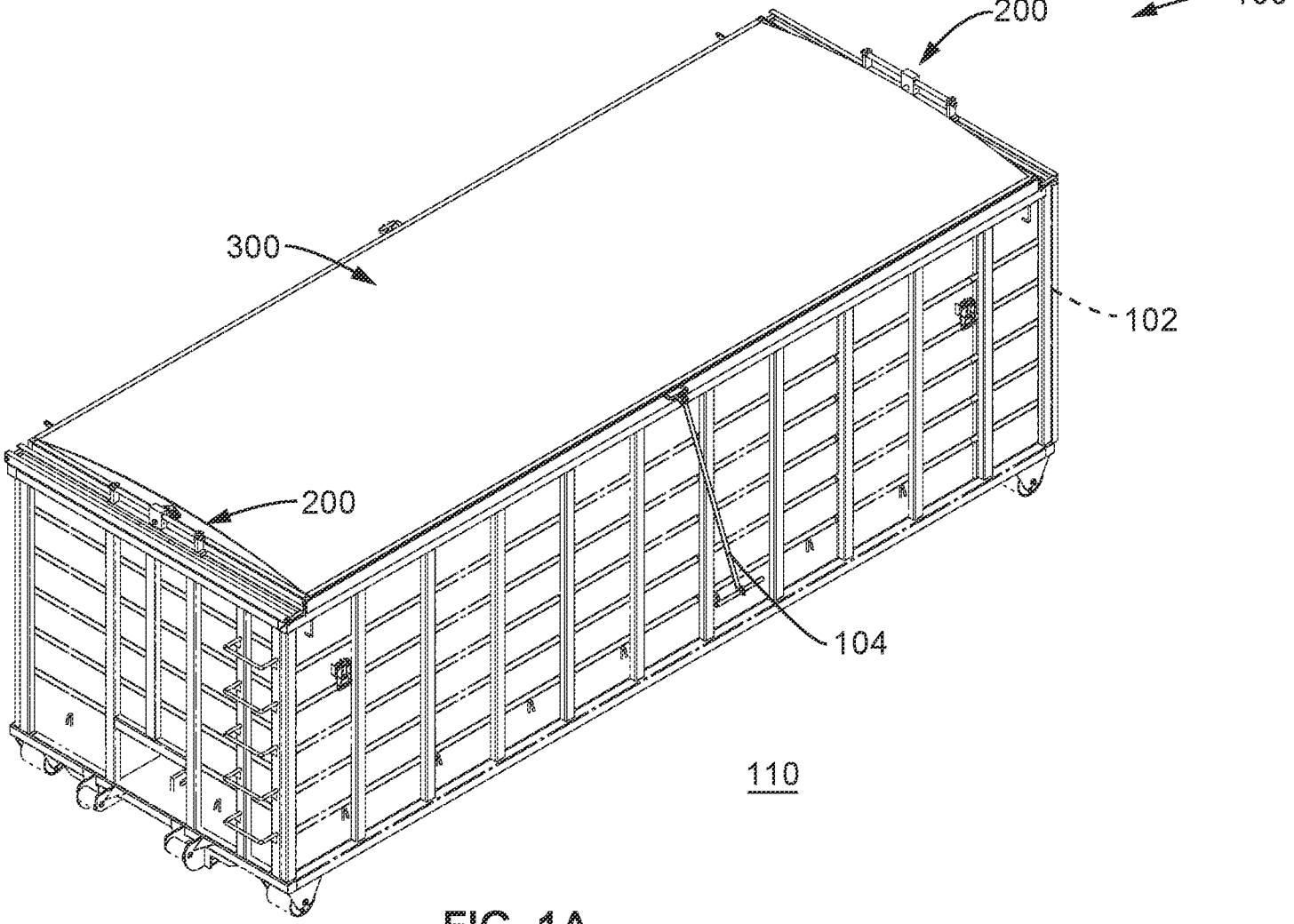
FIG. 1A is an isometric view of a prior art waste container that has affixed to it a side-to-side flip roof in a closed position.
Figure 1B:
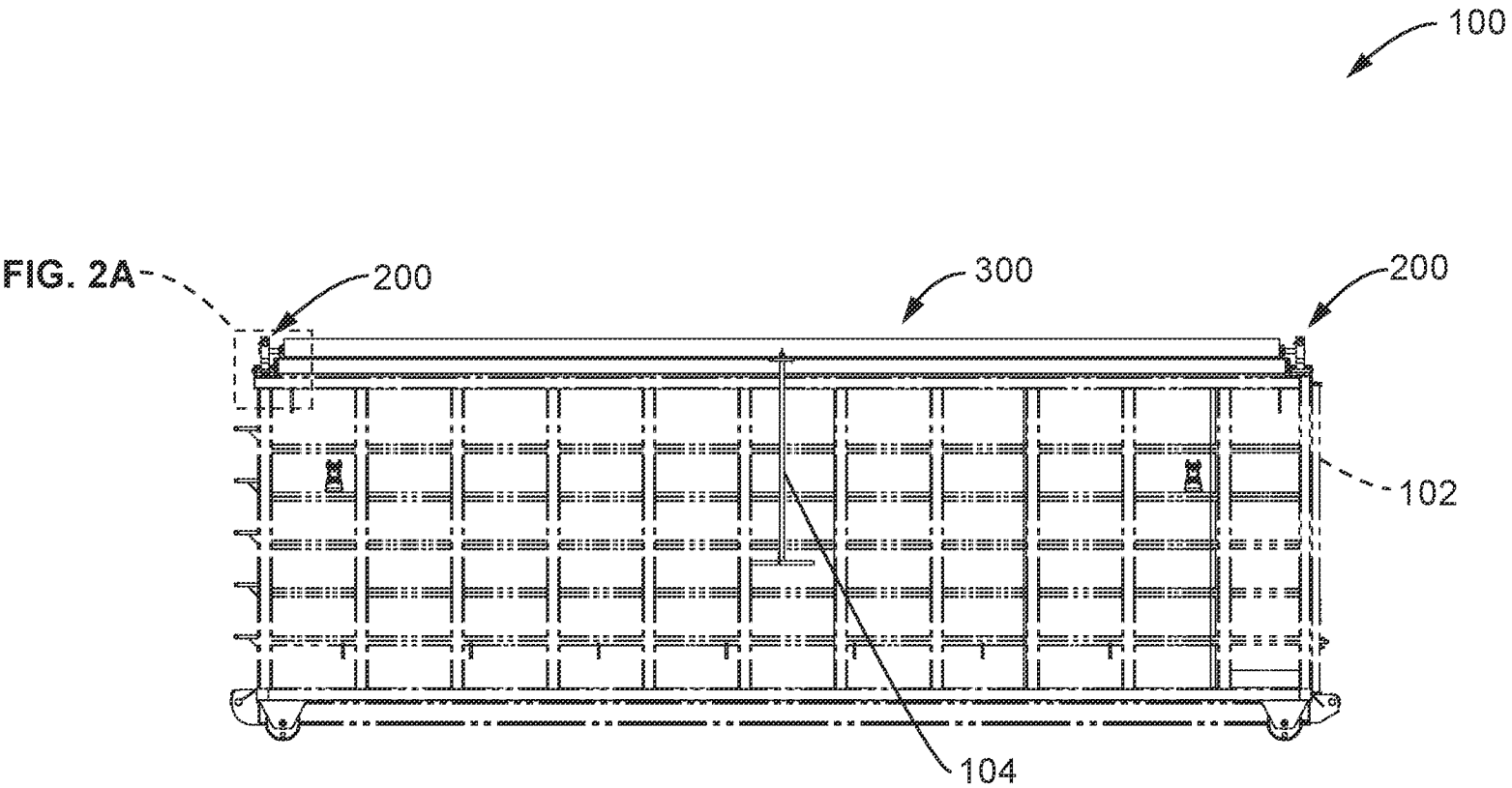
FIG. 1B is a side view of the waste container of FIG. 1A.
Figure 1C:
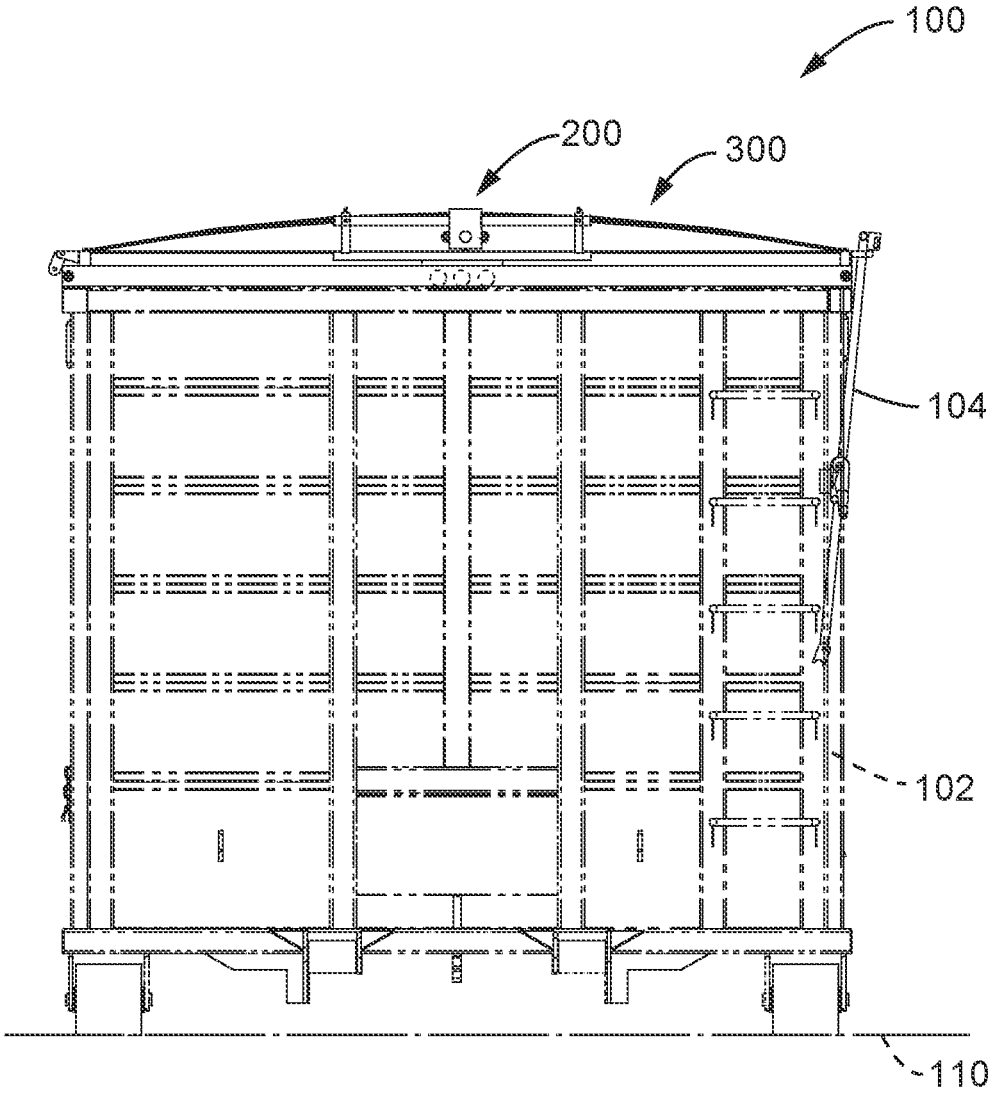
FIG. 1C is an end view of the waste container of FIG. 1A.

Refer now to FIGS. 1A, 1B, and 1C. FIG. 1A is an isometric view 100 of a prior art waste container 102 that has affixed to it a side-to-side mechanism 200 in two distal places, and a flip roof 300 shown in a closed position. In different viewing orientations, FIG. 1B is a side view of the waste container 102 of FIG. 1A, and FIG. 1C is an end view of the waste container 102 of FIG. 1A. In all of these views FIG. 1A, FIGS. 1B, and 1C, the flip roof 300 is shown in the closed position, where the flip roof 300 completely covers the prior art waste container 102. Actuation of the flip roof 300 is manually accomplished by pulling on a handle 104.

Figure 1D:
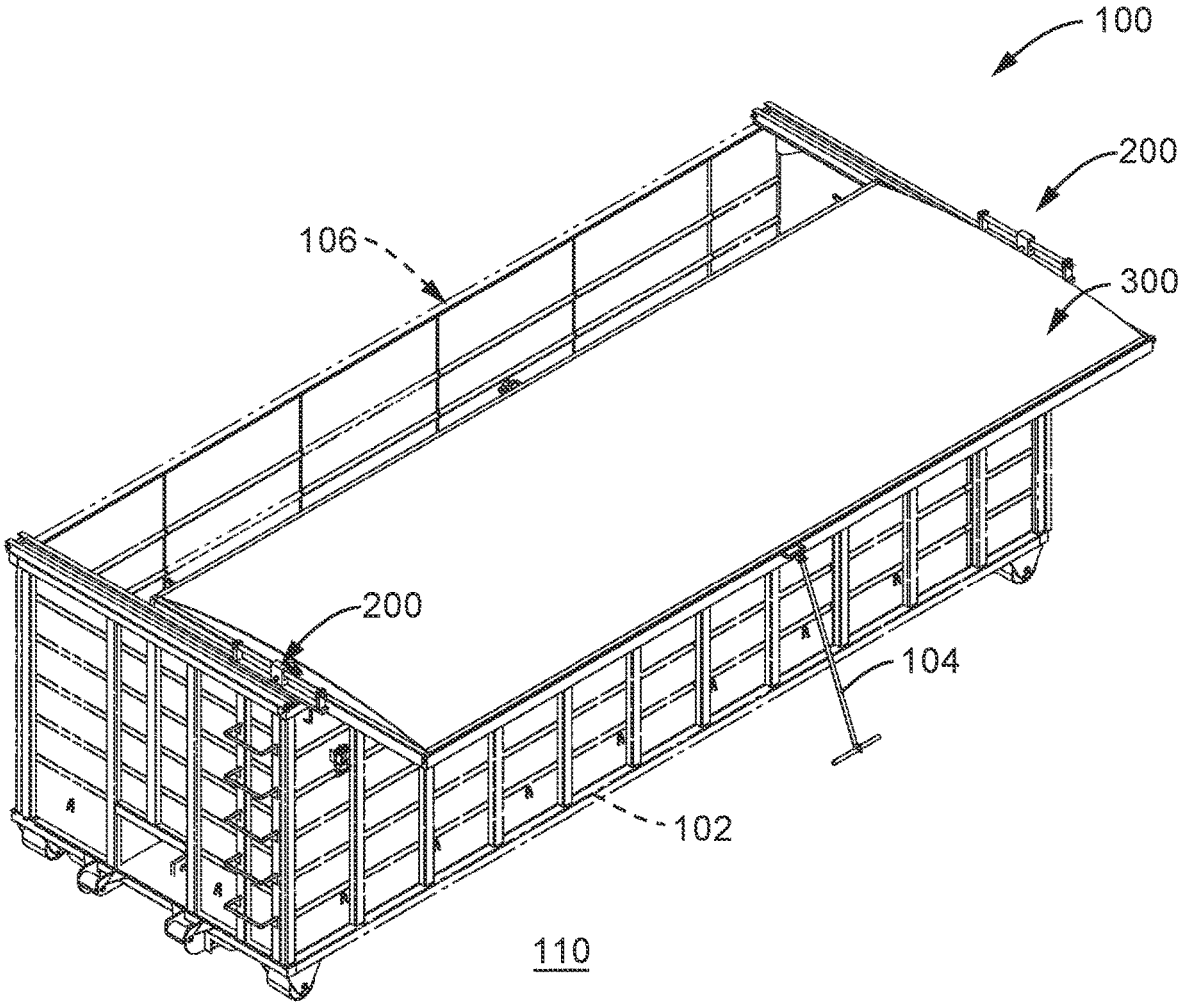
FIG. 1D is an isometric view of the waste container of FIG. 1A, wherein the roof has been partially rolled open using a manual handle.
Figure 1E:
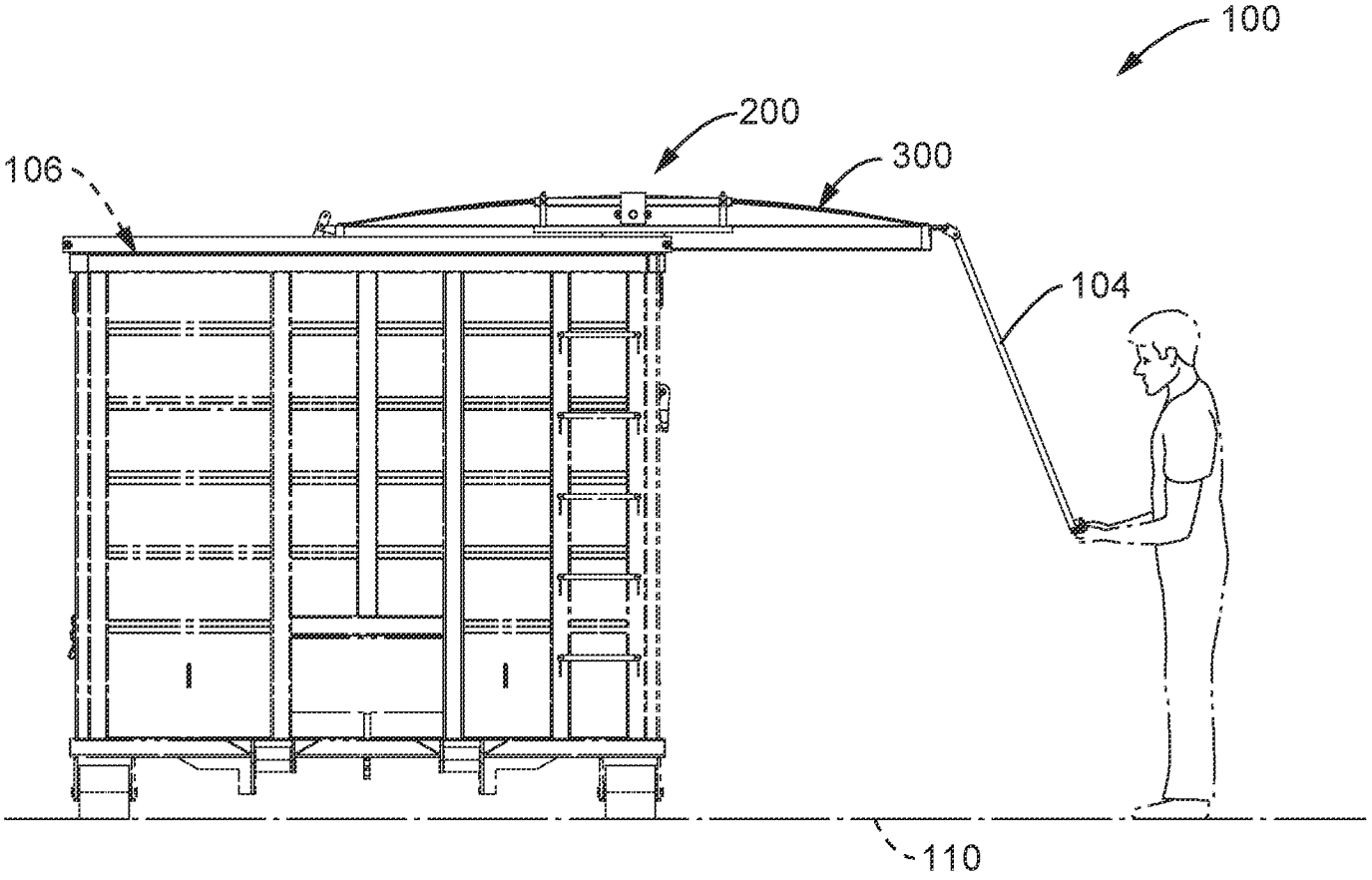
FIG. 1E is an end view of the waste container of FIG. 1D, wherein the roof has been partially rolled open using a manual handle.

Refer now to FIGS. 1D and 1E. FIG. 1D is an isometric view of the waste container 102 of FIG. 1A, wherein the flip roof 300 has been partially rolled open using a manual handle 104. Here, the flip roof 300 has been translated substantially parallel to the top 106 of the waste container 102 by translational movement of the side-to-side mechanism 200. Similarly, FIG. 1E is an end view of the waste container 102 of FIG. 1D, wherein the flip roof 300 has been partially rolled open using the manual handle 104.

Figure 1F:
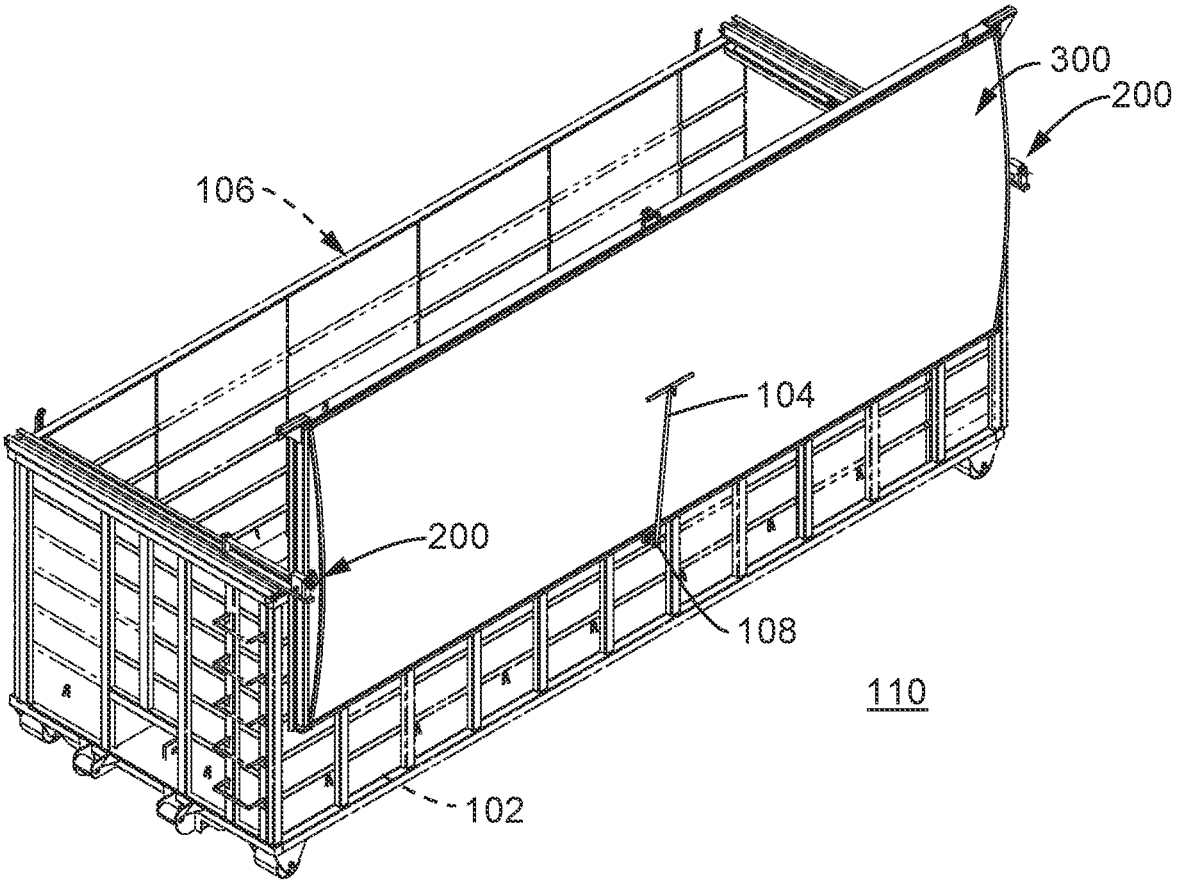
FIG. 1F is an isometric view of the waste container of FIG. 1A.

Refer now to FIG. 1F, which is an isometric view of the waste container 102 of FIG. 1A or FIG. 1D, wherein the flip roof 300 has been manually rolled open and flipped substantially vertically more or less 90° from the partially rolled open position shown previously in FIG. 1D. It should be noted that the vertical rotation of the flip roof 300 has been manually accomplished by the use of the manual handle 104, which has been pivoted upward about a handle pivot 108, so as to not otherwise rest on the ground 110 roughly parallel to the bottom of the waste container 102.

Figure 1G:
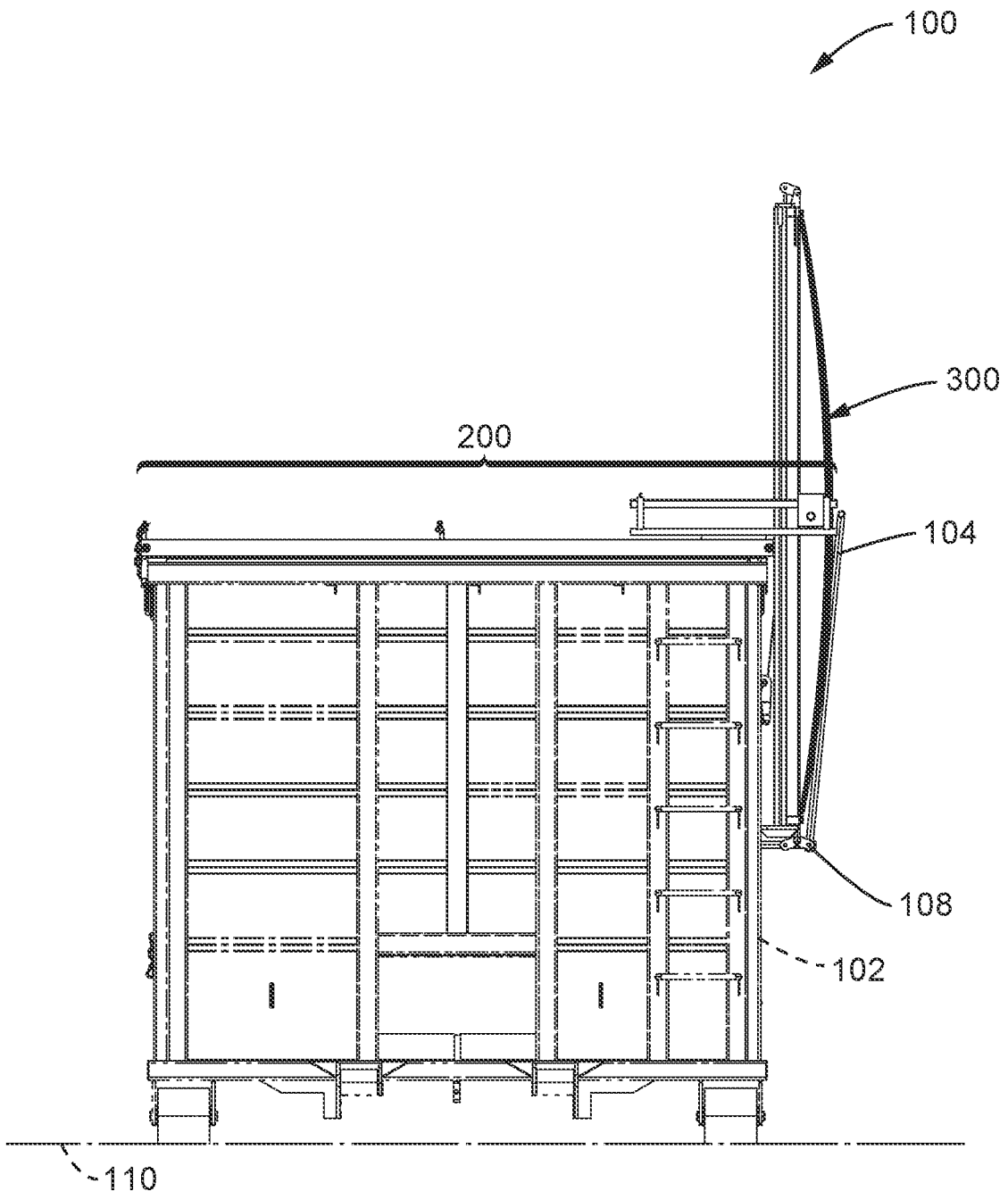
FIG. 1G is an end view of the waste container of FIG. 1F, wherein the roof has been rolled open and flipped vertically using a manual handle.

Refer now to FIG. 1G, which is an end view of the waste container 102 of FIG. 1F, wherein the flip roof 300 has been rolled open and flipped substantially vertically using the manual handle 104. After manually opening and flipping the roof 300, the manual handle 104 has been pivoted about the handle pivot 108 into a storage position, and is retained by a locking a tab.

Now that the overall description of what is to be accomplished with the flip roof 300 movement relative to the waste container 102, additional details of the side-to-side mechanism 200 can be described.

Refer back now to FIG. 2A, which is an enlarged side view of the side-to-side mechanism 200, which is attached to the top 106 of the prior art waste container 102. This attachment between of the side-to-side mechanism 200 and the top 106, not shown here, is typically performed by welding, but may be otherwise mechanically attached using nuts, bolts, or other mechanical fasteners. Here, only a portion of the flip roof 300 and one corner of the prior art waste container 102 are shown. The flip roof 300 is shown here in the closed position.

Figure 2A:
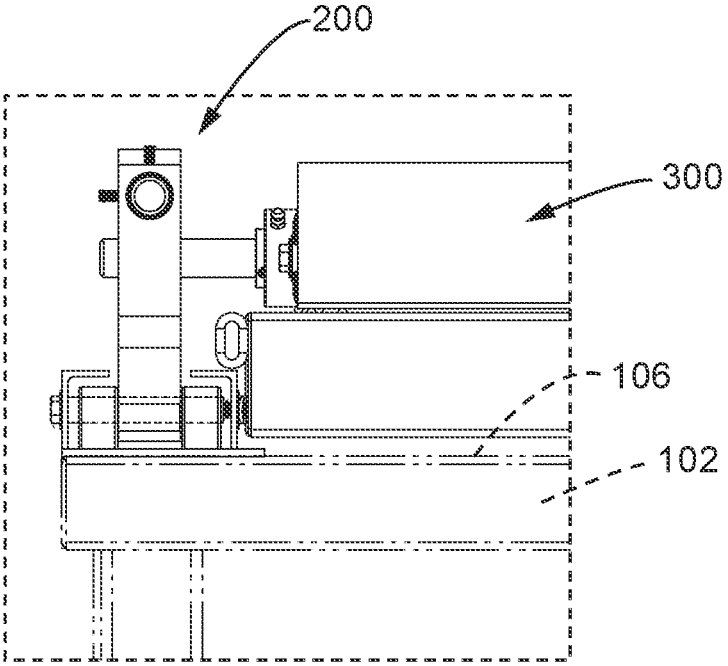
FIG. 2A is an enlarged side view of the carriage and carrier assembly 200 previously shown in FIG. 1B, wherein a portion of the flip roof at one end of a prior art waste container are shown magnified for clarity.
Figure 2B:
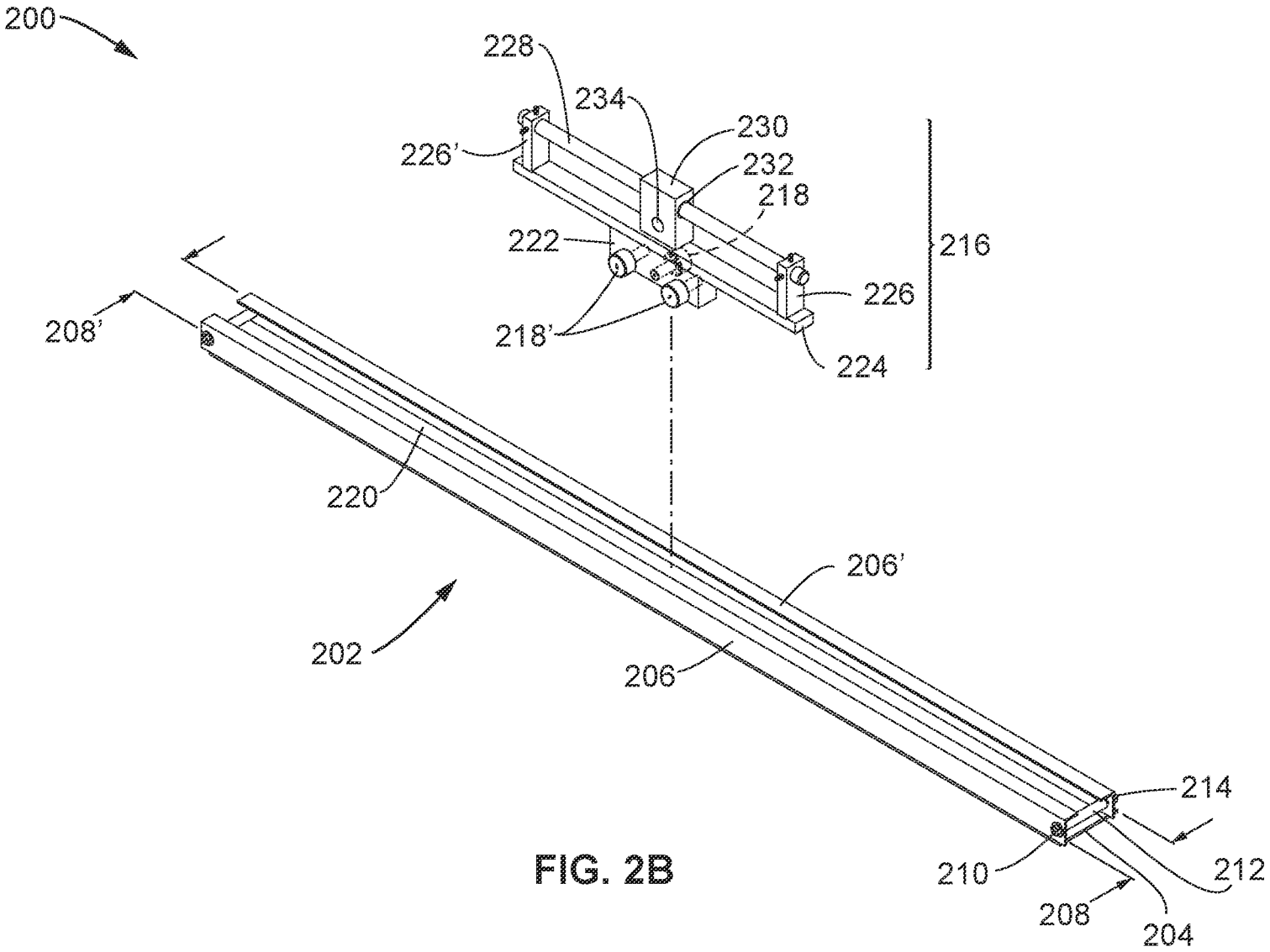
FIG. 2B is an isometric view of the carriage and carrier assembly 200 previously seen in FIG. 2A.

Refer now to FIG. 2B, which is a spaced-apart isometric view of the side-to-side mechanism 200 previously seen in FIG. 2A. A carriage 202 is constructed of a carriage slide base 204, to which is affixed two angles 206, 206' that face each other. A carrier stop 208 is formed by a bolt 210 that passes through the first angle 206, then a sleeve 212, then through the second angle 206', and is finally secured by a nut 214. An additional similar carrier stop 208' is found at the opposite side of the carriage 202.

A carrier assembly 216 is shown spaced above the carriage 202. Here, the carrier assembly 216 is shown disassembled from the carriage 202 for the sake of clarity. The carrier assembly 216 is comprised of a cam follower 218 that rides within the channel 220 formed by the affixed and spaced apart facing two angles 206 and 206'. The cam follower 218 is affixed to a carriage bar 222, which is in turn affixed to a carriage slide 224. It should be noted that the cam follower 218 is typically rotational in nature, able to turn freely relative to the carriage bar 222, within the channel 220. On the opposite side of the cam follower 218 are two additional cam followers 218', which allow for both of the angles 206 and 206' to act as vertical constraints to the carrier assembly 216 sliding motion. This vertical constraint is formed by the cam follower 218 and additional two cam followers 218' riding in the channel 220 of the carriage 202.

In assembly, the carrier assembly 216 would typically be inserted by the cam followers 218 and 218' being inserted within the channel 220 of the carriage 202 with one of the carrier stops 208 or 208' being temporarily removed, and replaced after assembly.

Primary Translational Motion

A primary translational motion occurs as the carrier assembly 216 translates within the channel 220 of the carriage 202. The limits of the primary translational motion occur by contact of the carriage bar 222 against either of the carrier stops 208 or 208' at the extremes of movement.

Refer again to FIGS. 1A, 1D, 1E, and 2B. This primary translational motion is of an insufficient range to allow for flip roof 300 clearance of the waste container 102 as desired as most clearly shown in FIG. 1E. It is recognized that the primary translational range could be increased; however, such increase would then make the carriage 202 wider than the waste container 102, which would lead to a projection of the carriage 202 beyond the lateral extent of the waste container 102, with obstruction possibilities and likelihood of carriage 202 damage due to such projection in typical use.

Refer back again to FIG. 2B. Here, the carriage slide 224 serves as a support for two slide bar mounts, 226 and 226' at opposite ends of the carriage slide 224. The two slide bar mounts 226 and 226' in turn support a shaft 228, upon which a hinged roller bearing 230 slides. The shaft 228 is secured in the two slide bar mounts 226 and 226' with set screws or other manner of attachment, and are not further detailed here to reduce drawing clutter. The carriage slide 224 actual translational sliding motion occurs between the shaft 228 and a pressed bushing 232 that is pressed into the hinged roller bearing 230. The hinged roller bearing 230 finally has a hinge pivot hole 234, through which the flip roof 300 subsequently attaches (not shown here).

Secondary Translational Motion

A secondary translational motion is created by the movement of the hinged roller bearing 230 sliding upon the shaft 228. Here, the hinged roller bearing 230 is constrained in its motion between the slide bar mounts 226 and 226'. This secondary translational motion allows for motion beyond that available to the primary translational motion previously described, which allows for the hinge pivot hole 234 to extend over and beyond the furthest lateral extent of the waste container 102, which in turn allows for the roof assembly to pivot, as previously shown in FIGS. 1F and 1G.

This secondary translational motion allows for the movement of the hinge pivot hole 234 beyond the lateral extent of the waste container 102, yet in the closed position maintains the entirety of the carriage 202 completely within the lateral extent of the waste container 102, thereby protecting the carriage 202 from possible damage that might otherwise occur if the carriage 202 extended beyond the lateral extent of the waste container 102.

Major Components

Figure 3A:
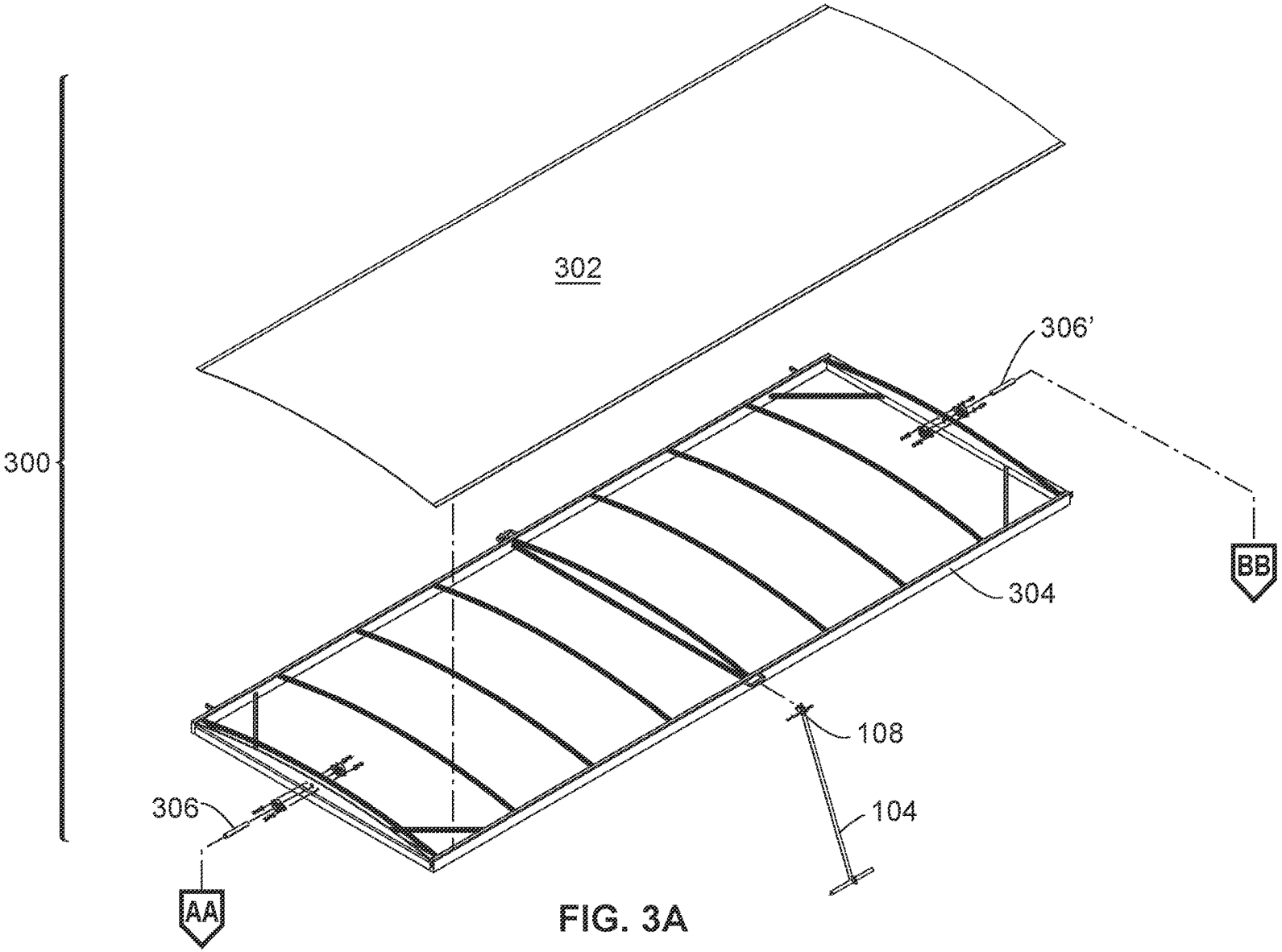
FIG. 3A is an exploded isometric view of the flip roof and flip roof frame of FIG. 1A in the closed configuration.

Refer now to FIG. 3A, which is an exploded isometric view of the flip roof 300 and flip roof frame of FIG. 1A, with the roof shown in the closed configuration. Here, a roof covering 302 is supported over a frame 304 that pivots on roof pins 306 and 306' at opposite ends of the frame 304. The roof covering 302 is typically a light plastic material with ultraviolet light resistant properties for prolonged outdoors usage in direct sunlight.

Figure 3B:
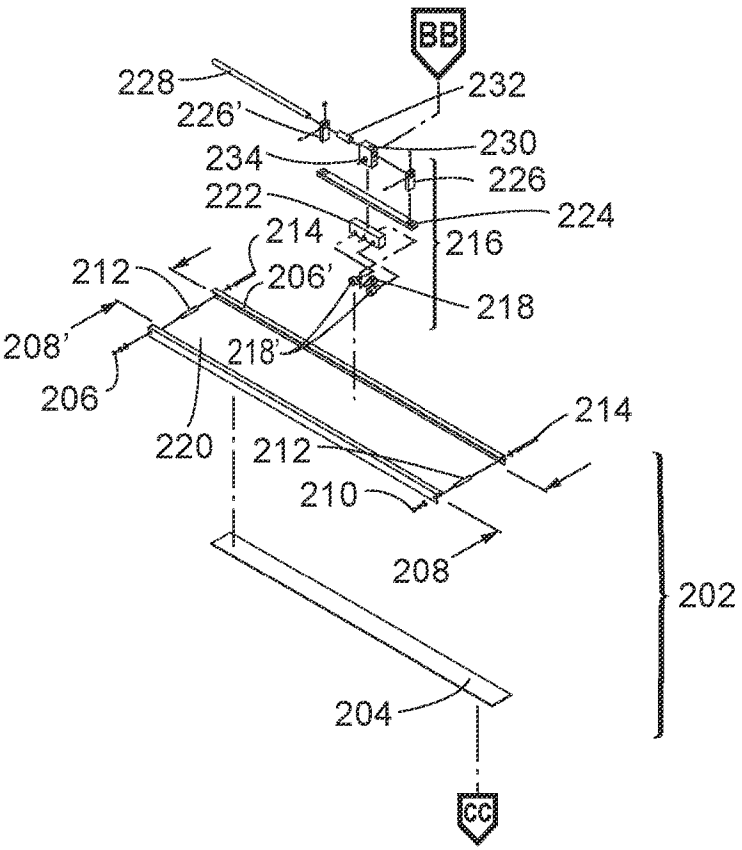
FIG. 3B is an exploded isometric view of the carriage and carrier assembly of FIG. 2B.
Figure 3B:
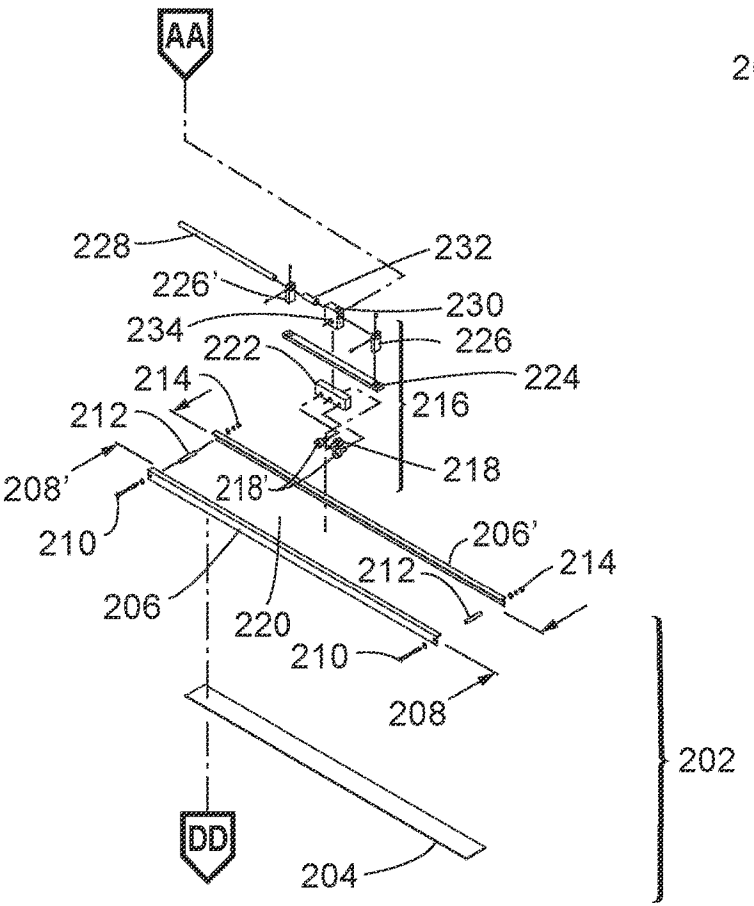

Refer now to FIG. 3B, which is an exploded isometric view of the carriage 202 and carrier assembly 216 of FIG. 2B. This view is provided here to better clarify the description previously given above regarding FIG. 2B.

Figure 3C:
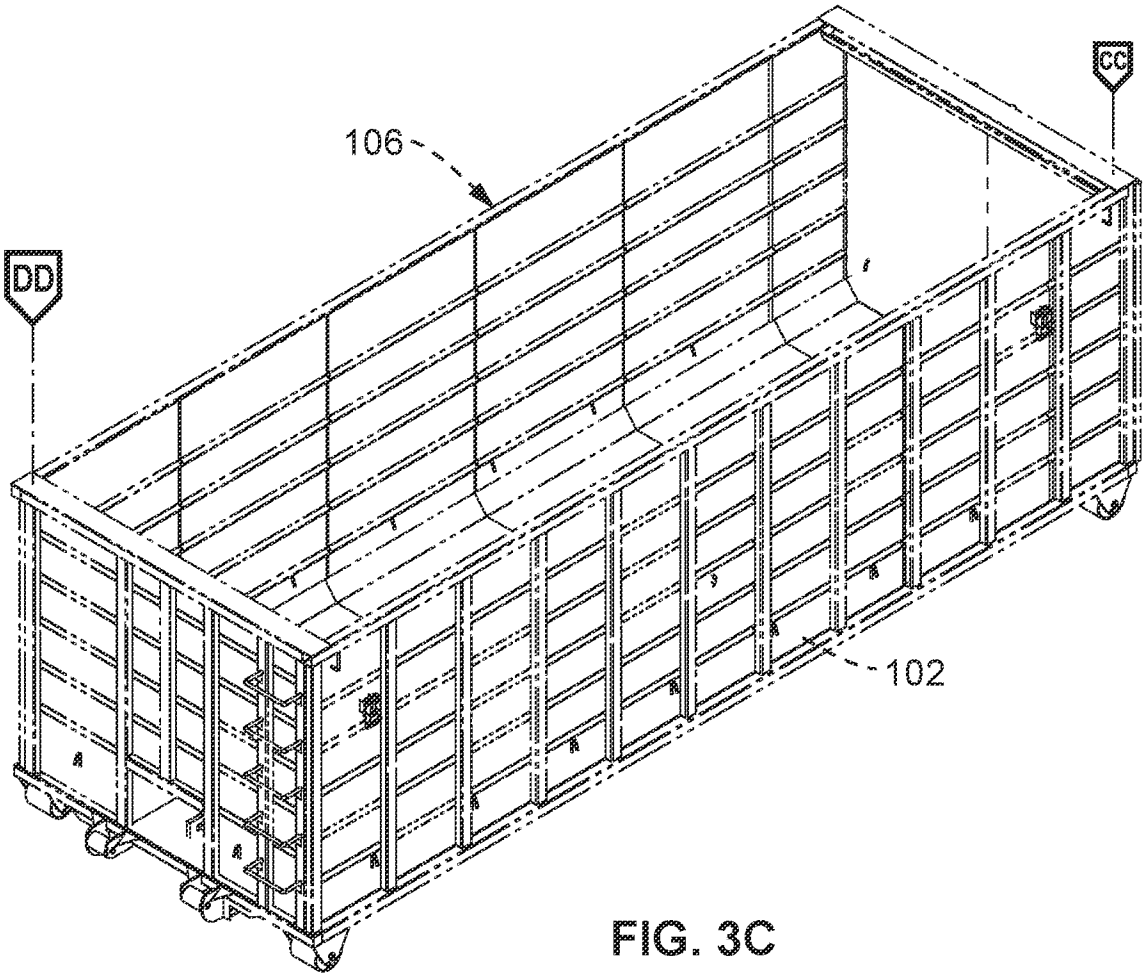
FIG. 3C is an isometric view of the prior art waste container 102 that allows for the mounting of the carriage and carrier assembly of FIG. 3B.

Refer now to FIG. 3C, which is an isometric view of the prior art waste container 102 that allows for the mounting of the carriage and carrier assembly of FIG. 3B to a portion of the top 106 of the prior art waste container 102.

Figure 4:
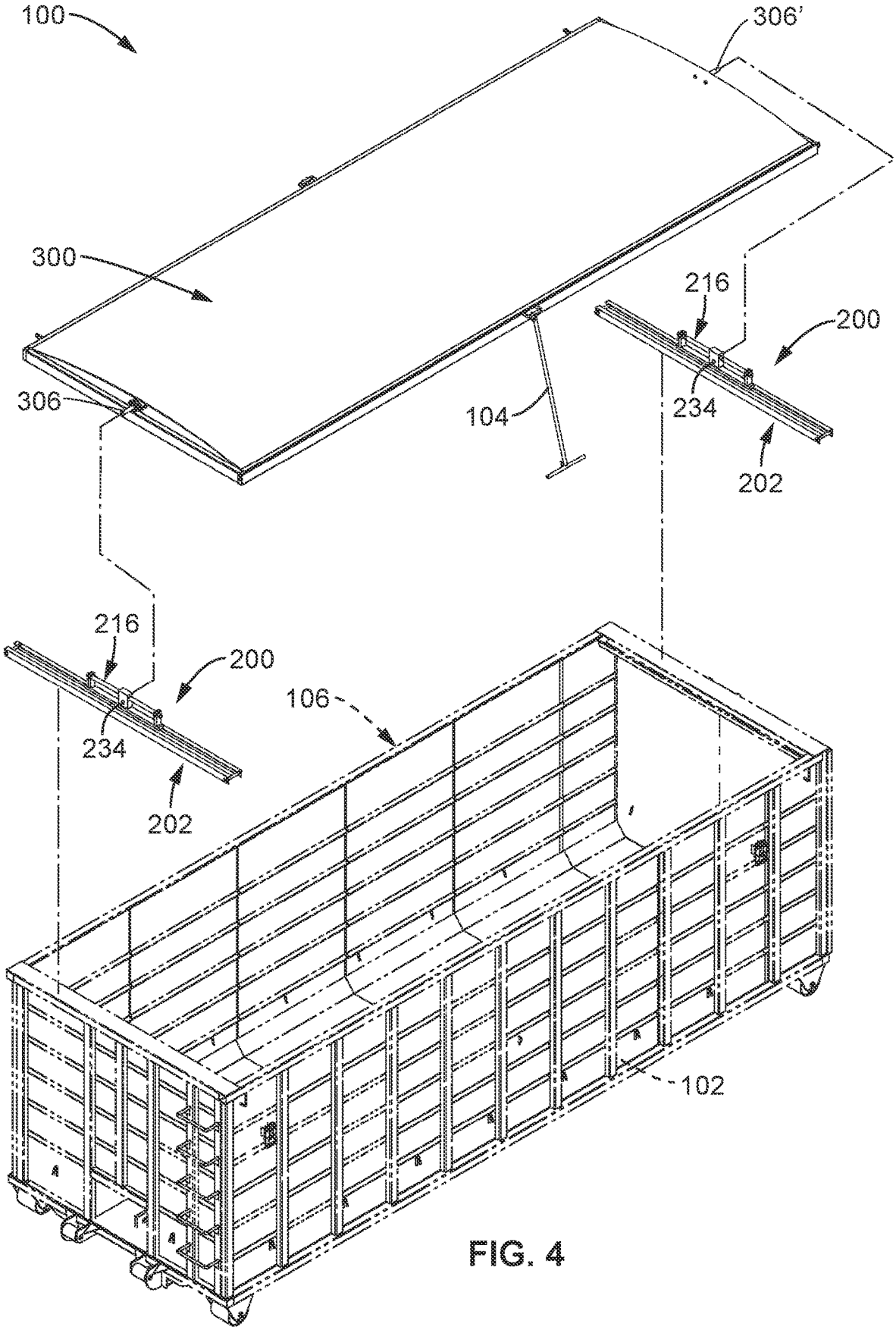
FIG. 4 is a partially exploded isometric view of the prior art waste container to which is attached the carriage and carrier assembly and flip roof, arranged in the closed configuration.

Refer now to FIG. 4, which is a partially exploded isometric view of the prior art waste container 102 to which is attached the side-to-side mechanism 200, which comprises the assembled carriage 202 and carrier assembly 216. The flip roof 300 attaches to the side-to-side mechanism 200 via roof pins 306 and 306' that allow for rotation in carrier assembly 216 hinge pivot holes 234. The overall rotation of roof pins 306 and 306' within the hinge pivot holes 234 allows for the overall rotation of the flip roof 300 to an open position substantially 90° to its otherwise closed orientation.

Overall Operation

Now that the details of the side-to-side flip roof have been explained, its operation may be more readily discerned.

Refer now to FIG. 1A, which shows the flip roof 300 in a substantially closed orientation. Refer now to FIG. 1E, where a user pulls on the handle 104 to slide the flip roof 300 aside to the point where the side-to-side mechanism 200 is at the limit of the primary translational motion, otherwise known as when the carriage bar 222 is contacted (or stopped) by one of the carrier stops 208 or 208' (the carrier stops 208 or 208' are most easily seen in FIG. 2B).

At this point, continued pulling on the handle 104 by the user pulls the hinged roller bearing 230 on shaft 228 until the hinged roller bearing 230 is stopped by one of the slide bar mounts 226 or 226' (again most easily seen in FIG. 2B) at the limit of the secondary translational motion. (This resulting secondary translational motion is seen most clearly in FIG. 1G, although here, the flip roof 300 has been pivoted.)

Refer now tot FIG. 1G. Continued pulling on the handle 104 by the user causes the flip roof 300 to pivot. Here, the handle 104 use has been completed, and has been rotated about the handle pivot 108 vertically to a latching stop (not shown) for storage.

In this orientation with the flip roof 300 substantially vertical, the waste container 102 is open and ready for loading. Note that the waste container 102 could have been opened from either side be using the manual handle 104 on the opposite side of the flip roof 300.

After loading the contents of the waste container 102, the steps are essentially reversed, resulting in a container configuration shown again in FIG. 1A, but with the contents of the waste container 102 loaded (not shown). The waste contents are now protected from water ingress by the flip roof 300, as well as inadvertent road littering during transport.

From the description herein, it will be appreciated that the present disclosure encompasses multiple implementations of the technology which include, but are not limited to, the following:

A side-to-side flip roof apparatus, comprising: (a) a set of two carriages; (b) a carrier assembly slidably restrained by its respective carriage; (i) wherein each carrier assembly translates as constrained by its respective carriage in a primary translational motion; (ii) wherein each carrier assembly further comprises: (A) a shaft substantially parallel to its primary translational motion; (B) a hinged roller bearing that slides upon the shaft; and (C) a hinge pivot hole disposed within the hinged roller bearing; (c) a roof comprising two roof pins rotationally constrained by the hinge pivot hole of each of the carrier assemblies; (d) wherein after traversing the primary translational motion of the carrier assembly within its respective carriage, the hinged roller bearing slides upon its shaft for an extended translation in a secondary translational motion; (e) wherein at an end of the secondary translational motion, the roof may be pivoted about the roof pins from a substantially horizontal orientation to a substantially vertical orientation through rotation of the roof pins within their respective hinge pivot holes.

The apparatus or method or system of any preceding or following implementation, wherein said carriage further comprises: (a) a carriage slide base; (b) two carriage supports attached to the carriage slide base so as to form a channel therebetween.

The apparatus or method or system of any preceding or following implementation, wherein each carriage is affixed to a top of a waste container.

The apparatus or method or system of any preceding or following implementation, further comprising manual pull handle removably attached to one side of the roof at a pivot A side-to-side flip roof apparatus, comprising: (a) a flip roof; (b) means for translating a carrier assembly within a carriage to perform a primary translational motion; (c) means for translating a hinge pivot hole within the carrier assembly to perform a secondary translational motion; (d) means for rotating the flip roof about the hinge pivot hole.

The means for translating the carrier assembly may include, but is not limited to: any translational mechanism, such as a roller and track, a V-roller set translating on an inverted track; a rack and pinion; a guide bar with a follower; and rimmed wheels following a track (as used in railroads). The means for translating the carrier assembly may also restrain the carrier assembly, so as to prevent excursions beyond their designed limits, such as a limit stop. So long as the carrier assembly is able to shift substantially in a single direction by virtue of a mechanism, then such mechanism would qualify as a means for translating of the carrier assembly.

The apparatus or method or system of any preceding or following implementation, wherein the means for translating the carrier assembly further comprises: (a) a carriage slide base; (b) two facing spaced apart right angle carriage supports affixed to the carriage slide base, wherein a channel is formed therebetween; and (c) carrier stop disposed between the carriage supports, whereby the carrier assembly translation is limited within the channel.

The apparatus or method or system of any preceding or following implementation, wherein the means for translating the hinge pivot hole further comprises: (a) a carriage slide; (b) one or more slide bar mounts attached to the carriage slide; (c) a shaft attached to the slide bar mount; (d) a hinge roller bearing slidably attached to the shaft, the hinge roller bearing comprising a hinge pivot hole.

The means for translating the hinge pivot hole may include, but is not limited to: any translational mechanism, such as a roller and track, a V-roller set translating on an inverted track; a rack and pinion; a guide bar with a follower; and rimmed wheels following a track (as used in railroads). The means for translating the hinge pivot hole may also restrain the hinge pivot hole, so as to prevent excursions beyond their designed limits, such as a limit stop. So long as the hinge pivot hole is able to shift substantially in a single direction by virtue of a mechanical device, then such device would qualify as a means for translating of the hinge pivot hole.

The apparatus or method or system of any preceding or following implementation, wherein the means for rotating the flip roof further comprises: (a) a roof pin affixed to the flip roof, wherein the roof pin is rotationally constrained by the hinge pivot hole; and (b) a manual pull handle rotationally and removably attached to the roof.

The means for rotating the flip roof may include, but is not limited to: any rotational mechanism, such as a rotating pin and bearing, and an axle rotating within a bearing set. The means for rotating the flip roof may also restrain the flip roof rotational angle, so as to prevent excursions beyond their designed limits, such as a limit stop. So long as the flip roof is able to rotate substantially in a single axis by virtue of a mechanical device, then such device would qualify as a means for rotating of the flip roof.

A method for side-to-side flipping of a roof of a waste container, the method comprising: (a) providing a waste container comprising a near side and a far side; (b) providing a carriage affixed to a top of the waste container, spanning the near side to the far side; (c) providing a carrier assembly riding within a channel of the carriage; (d) providing a hinge pivot hole slidably disposed within the carrier assembly; (e) wherein sliding of the carrier assembly within the channel of the carriage constitutes a primary translational motion; (f) wherein sliding of the hinge pivot hole within the carrier assembly constitutes a secondary translational motion; (g) providing a flip roof comprising a roof pin rotatably inserted into the hinge pivot hole; (h) moving the carrier assembly from a central position between the near side and far side to the near side using the primary translational motion; (i) moving the hinge pivot hole through the secondary translational motion beyond a lateral extent of the waste container; and (j) pivoting the flip roof about the hinge pivot hole by rotation of the roof pin relative to the hinge pivot hole substantially 90°.

The apparatus or method or system of any preceding or following implementation, wherein the pivoting step is accomplished by pulling on a manually operated handle rotationally attached to the flip roof.

A flip roof of a container, comprising: (a) a frame; (b) a roof covering coupled to the frame; (c) a side-to-side opening mechanism in communication with the frame and including a means for coupling with a container having two sides, wherein the roof covering is configured to be movable between a closed position that substantially covers an opening of the container, and an open position which allows access to a substantial portion of the opening on either of the two sides of the container.

The apparatus or method or system of any preceding or following implementation, wherein the roof covering is configured to be manually movable.

As used herein, term "implementation" is intended to include, without limitation, embodiments, examples, or other forms of practicing the technology described herein.

As used herein, the singular terms "a," "an," and "the" may include plural referents unless the context clearly dictates otherwise. Reference to an object in the singular is not intended to mean "one and only one" unless explicitly so stated, but rather "one or more."

Phrasing constructs, such as "A, B and/or C", within the present disclosure describe where either A, B, or C can be present, or any combination of items A, B and C. Phrasing constructs indicating, such as "at least one of" followed by listing a group of elements, indicates that at least one of these group elements is present, which includes any possible combination of the listed elements as applicable.

References in this disclosure referring to "an embodiment", "at least one embodiment" or similar embodiment wording indicates that a particular feature, structure, or characteristic described in connection with a described embodiment is included in at least one embodiment of the present disclosure. Thus, these various embodiment phrases are not necessarily all referring to the same embodiment, or to a specific embodiment which differs from all the other embodiments being described. The embodiment phrasing should be construed to mean that the particular features, structures, or characteristics of a given embodiment may be combined in any suitable manner in one or more embodiments of the disclosed apparatus, system or method.

As used herein, the term "set" refers to a collection of one or more objects. Thus, for example, a set of objects can include a single object or multiple objects.

Relational terms such as first and second, top and bottom, primary and secondary. and the like may be used solely to distinguish one entity or action from another entity or action without necessarily requiring or implying any actual such relationship or order between such entities or actions.

The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element.

As used herein, the terms "approximately", "approximate", "substantially", "essentially", and "about", or any other version thereof, are used to describe and account for small variations. When used in conjunction with an event or circumstance, the terms can refer to instances in which the event or circumstance occurs precisely as well as instances in which the event or circumstance occurs to a close approximation. When used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, "substantially" aligned can refer to a range of angular variation of less than or equal to +10°, such as less than or equal to 5°, less than or equal to ±4°, less than or equal to ±3°, less than or equal to 2°, less than or equal to 1°, less than or equal to 0.5°, less than or equal to ±0.1°, or less than or equal to ±0.05°.

Additionally, amounts, ratios, and other numerical values may sometimes be presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified. For example, a ratio in the range of about 1 to about 200 should be understood to include the explicitly recited limits of about 1 and about 200, but also to include individual ratios such as about 2, about 3, and about 4, and sub-ranges such as about 10 to about 50, about 20 to about 100, and so forth.

The term "coupled" as used herein is defined as connected, although not necessarily directly and not necessarily mechanically. A device or structure that is "configured" in a certain way is configured in at least that way, but may also be configured in ways that are not listed.

Benefits, advantages, solutions to problems, and any element(s) that may cause any benefit, advantage, or solution to occur or become more pronounced are not to be construed as a critical, required, or essential features or elements of the technology describes herein or any or all the claims.

In addition, in the foregoing disclosure various features may grouped together in various embodiments for the purpose of streamlining the disclosure. This method of disclosure is not to be interpreted as reflecting an intention that the claimed embodiments require more features than are expressly recited in each claim. Inventive subject matter can lie in less than all features of a single disclosed embodiment.

The abstract of the disclosure is provided to allow the reader to quickly ascertain the nature of the technical disclosure. It is submitted with the understanding that it will not be used to interpret or limit the scope or meaning of the claims.

It will be appreciated that the practice of some jurisdictions may require deletion of one or more portions of the disclosure after that application is filed. Accordingly, the reader should consult the application as filed for the original content of the disclosure. Any deletion of content of the disclosure should not be construed as a disclaimer, forfeiture or dedication to the public of any subject matter of the application as originally filed.

The following claims are hereby incorporated into the disclosure, with each claim standing on its own as a separately claimed subject matter.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

All structural and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

What is claimed is:

1. A side-to-side flip roof apparatus, comprising:

(a) a set of two carriages;

(b) a carrier assembly slidably restrained by its respective carriage;

(i) wherein each carrier assembly translates as constrained by its respective carriage in a primary translational motion;

(ii) wherein each carrier assembly further comprises:

(A) a shaft substantially parallel to its primary translational motion;

(B) a hinged roller bearing that slides upon the shaft; and (C) a hinge pivot hole disposed within the hinged roller bearing;

(c) a roof comprising two roof pins rotationally constrained by the hinge pivot hole of each of the carrier assemblies;

(d) wherein after traversing the primary translational motion of the carrier assembly within its respective carriage, the hinged roller bearing slides upon its shaft for an extended translation in a secondary translational motion;

(e) wherein at an end of the secondary translational motion, the roof may be pivoted about the roof pins from a substantially horizontal orientation to a substantially vertical orientation through rotation of the roof pins within their respective hinge pivot holes.

2. The apparatus of claim 1, wherein said carriage further comprises:

(a) a carriage slide base;

(b) two carriage supports attached to the carriage slide base so as to form a channel therebetween.

3. The apparatus of claim 1, wherein each carriage is affixed to a top of a waste container.

4. The apparatus of claim 1, further comprising a manual pull handle removably attached to one side of the roof at a pivot.

5. A side-to-side flip roof apparatus, comprising:

(a) a flip roof;

(b) means for translating a carrier assembly within a carriage to perform a primary translational motion;

(c) means for translating a hinge pivot hole within the carrier assembly to perform a secondary translational motion;

(d) means for rotating the flip roof about the hinge pivot hole.

6. The side-to-side flip roof apparatus of claim 5, wherein the means for translating the carrier assembly further comprises:

(a) a carriage slide base;

(b) two facing spaced apart right angle carriage supports affixed to the carriage slide base, wherein a channel is formed therebetween; and (c) a carrier stop disposed between the carriage supports, whereby the carrier assembly translation is limited within the channel.

7. The side-to-side flip roof apparatus of claim 5, wherein the means for translating the hinge pivot hole further comprises:

(a) a carriage slide;

(b) one or more slide bar mounts attached to the carriage slide;

(c) a shaft attached to the slide bar mount;

(d) a hinge roller bearing slidably attached to the shaft, the hinge roller bearing comprising a hinge pivot hole.

8. The side-to-side flip roof apparatus of claim 7, wherein the means for rotating the flip roof further comprises:

(a) a roof pin affixed to the flip roof, wherein the roof pin is rotationally constrained by the hinge pivot hole; and (b) a manual pull handle rotationally and removably attached to the roof.

9. A method for side-to-side flipping of a roof of a waste container, the method comprising:

(a) providing a waste container comprising a near side and a far side;

(b) providing a carriage affixed to a top of the waste container, spanning the near side to the far side;

(c) providing a carrier assembly riding within a channel of the carriage;

(d) providing a hinge pivot hole slidably disposed within the carrier assembly;

(e) wherein sliding of the carrier assembly within the channel of the carriage constitutes a primary translational motion;

(f) wherein sliding of the hinge pivot hole within the carrier assembly constitutes a secondary translational motion;

(g) providing a flip roof comprising a roof pin rotatably inserted into the hinge pivot hole;

(h) moving the carrier assembly from a central position between the near side and far side to the near side using the primary translational motion;

(i) moving the hinge pivot hole through the secondary translational motion beyond a lateral extent of the waste container; and (j) pivoting the flip roof about the hinge pivot hole by rotation of the roof pin relative to the hinge pivot hole substantially 90°.

10. The method of claim 9, wherein the pivoting step is accomplished by pulling on a manually operated handle rotationally attached to the flip roof.

11. A flip roof of a container, comprising:

(a) a frame;

(b) a roof covering coupled to the frame;

(c) a side-to-side opening mechanism in communication with the frame and including a means for coupling with a container having two sides, wherein the roof covering is configured to be movable between a closed position that substantially covers an opening of the container, and an open position which allows access to a substantial portion of the opening on either of the two sides of the container.

12. The flip roof of the container of claim 11, wherein the roof covering is configured to be manually movable.

* * * * *